US007129406B2

(12) United States Patent
Sakurada

(10) Patent No.: US 7,129,406 B2
(45) Date of Patent: Oct. 31, 2006

(54) AUTOMATIC PERFORMANCE APPARATUS

(75) Inventor: Shinya Sakurada, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 184 days.

(21) Appl. No.: 10/608,713

(22) Filed: Jun. 26, 2003

(65) Prior Publication Data

US 2005/0257666 A1 Nov. 24, 2005

(30) Foreign Application Priority Data

Jul. 10, 2002 (JP) ..... 2002-201991

(51) Int. Cl.
*A63H 5/00* (2006.01)
*G04B 13/00* (2006.01)
*G10H 7/00* (2006.01)

(52) U.S. Cl. ..... 84/609; 84/645

(58) Field of Classification Search ..... 84/609, 84/634, 645

See application file for complete search history.

(56) References Cited

U.S. PATENT DOCUMENTS 4,757,736 A 7/1988 Tajima et al.
5,367,121 A * 11/1994 Yanase ..... 84/666
5,391,829 A 2/1995 Hasebe et al.
5,574,243 A * 11/1996 Nakai et al. ..... 84/609
5,600,082 A * 2/1997 Torimura ..... 84/610
5,967,792 A * 10/1999 Matsumoto ..... 434/307 A
6,346,666 B1 2/2002 Tsai et al.
6,429,366 B1 * 8/2002 Terada ..... 84/645
6,504,090 B1 1/2003 Tsai et al.

FOREIGN PATENT DOCUMENTS

JP 08-030284 2/1996
JP 10-097250 4/1998
JP 10-301568 11/1998
JP 2001-154668 6/2001

* cited by examiner

*Primary Examiner*—Jeffrey W Donels
(74) *Attorney, Agent, or Firm*—Morrison & Foerster LLP

(57) ABSTRACT

An automatic performance apparatus reproduces, by a program process executed on a computer, automatic performance data comprising a series of performance data which is assigned to one channel of a plurality of channels and to which a channel number representative of the assigned channel is added. The automatic performance data contains identification data representative of a musical instrument or performance part to be performed by the performance data which is assigned to each channel. To the identification data, a channel number representative of the assigned channel is also added. Based on the identification data, musical instruments or performance parts to be performed by each of the performance data are identified. As a result, the present invention configured as above provides users with easy specification of musical instrument or performance part to be excluded from a performance or to be performed during the reproduction of performance data, enabling the reproduction and non-reproduction of each performance part to be precisely controlled.

10 Claims, 7 Drawing Sheets

FIG.5A

<music data format>

| |
|---|
| timing data |
| event data |
| timing data |
| event data |
| |
| end data |

FIG.5B

| |
|---|
| category status |
| channel status |
| performance data (guitar) |
| channel status |
| performance data (piano) |
| channel status |
| performance data (piano, melody) |

FIG.6

| main category | sub-category | melody attribute | mute |
|---|---|---|---|
| 00(piano) | 20(right hand) | 00(melody 1) | M |
| 00(piano) | 21(left hand) | 255(non-melody) | |
| 01(guitar) | 24(lead 1) | 255(non-melody) | |
| 01(guitar) | 32(backing 1) | 255(non-melody) | |
| : | : | : | |
| : | : | : | |

FIG.7

| ch | main category | sub-category | melody attribute |
|---|---|---|---|
| 1 | 00(piano) | 20(right hand) | 00(melody 1) |
| 2 | 00(piano) | 21(left hand) | 255(non-melody) |
| 3 | 01(guitar) | 24(lead 1) | 255(non-melody) |
| 4 | 01(guitar) | 32(backing 1) | 255(non-melody) |
| : | : | : | : |
| 16 | 255(unspecified) | 255(unspecified) | 255(non-melody) |

FIG.8A

| main category | denotation |
|---|---|
| 00(piano) | Piano |
| 01(guitar) | Guitar |
| 02(bass) | Bass |
| : | : |
| 255(unspecified) | (no denotation) |

| sub-category | denotation |
|---|---|
| : | : |
| 20(right hand) | R.Hand |
| 21(left hand) | L.Hand |
| : | : |
| 24(lead 1) | Lead1 |
| : | : |
| 255(unspecified) | (no denotation) |

| melody attribute | denotation |
|---|---|
| 00(melody1) | Melody1 |
| 01(melody2) | Melody2 |
| 02(melody3) | Melody3 |
| : | : |
| 255(non-melody) | (no denotation) |

FIG.8B

| main category | denotation |
|---|---|
| 00(option1) | Suzuki |
| 01(option2) | Nakata |
| 02(option3) | Sato |
| : | : |

| sub-category | denotation |
|---|---|
| 00(option1) | Vocal |
| 01(option2) | Chorus1 |
| 2(option3) | Chorus2 |
| : | : |

| melody attribute | denotation |
|---|---|
| 00(option1) | Melody |
| 01(option2) | Soprano |
| 02(option3) | Alto |
| : | : |

AUTOMATIC PERFORMANCE APPARATUS

BACKGROUND OF THE INVENTION

1. Field of the Invention

The present invention relates to an automatic performance apparatus for reproducing automatic performance data comprising a series of performance data, an automatic performance program run on a computer in order to reproduce the automatic performance data, and a storage medium storing the automatic performance data.

2. Description of the Related Art

As described in Japanese Patent Laid-Open No. H10-97250, an automatic performance apparatus has been well-known which reproduces automatic performance data comprising a series of performance data to which channel numbers each of which is assigned to one channel among a plurality of channels and represents the assigned channel are added. In the automatic performance apparatus, a specific channel or instrument (a tone color) is designated in order to block the reproduction of performance data on the designated channel or musical instrument. Alternatively, the designation is made in order to allow the reproduction of performance data on the designated channel or musical instrument, while blocking the reproduction of performance data on other channels or musical instruments.

However, the above conventional art poses an inconvenience to a user. Namely, the user is required to know all the performance parts or musical instruments assigned to the channels in order to make a designation. Furthermore, the conventional art is insufficient in that, in a case of one musical instrument being assigned to a plurality of channels such as a backing part and solo part, the designation is unable to be done because performance data to be blocked or to be performed solo cannot be identified.

SUMMARY OF THE INVENTION

The present invention was accomplished to solve the above-described problems, and an object thereof is to provide an automatic performance apparatus allowing for easy specification of a performance part to be reproduced or not to be reproduced with the reproduction or non-reproduction appropriately controlled, an automatic performance program executed on a computer in order to reproduce the automatic performance data, and a storage medium storing the automatic performance data.

In order to achieve the above-described object, a feature of the present invention lies in the automatic performance apparatus for reproducing automatic performance data which has a series of performance data assigned to any one channel of a plurality of channels, the series of performance data in which identification data representative of a musical instrument or performance part performed by performance data assigned to each channel is assigned to each of the channels, the automatic performance apparatus comprising a reproduction condition specification portion for specifying a musical instrument or performance part to be excluded from a performance during the reproduction of performance data, or to be performed with other musical instrument or other performance part excluded from a performance during the reproduction of performance data, and a reproduction control portion for identifying a musical instrument or performance part to be performed by each performance data based on the identification data, and controlling reproduction and non-reproduction of each performance data in accordance with the reproduction condition specified by the reproduction condition specification portion.

In this case, for example, the automatic performance apparatus may be constructed such that the reproduction condition specification portion includes a mute state register which stores, on the basis of the specification of a musical instrument or performance part, mute data indicating whether each musical instrument or performance part is to be reproduced in corresponding relation to the musical instrument or performance part, and the reproduction control portion includes an identification data register which stores the identification data during reproducing the series of performance data, a first detector which refers to the identification data stored in the identification data register and detects a musical instrument or performance part to be performed by each of the performance data by use of the channels assigned to each of the performance data, and a second detector which refers to mute data stored in the mute state register and detects by use of the detected musical instrument or performance part whether each of the performance data is to be reproduced.

According to this feature, the user's specification of a musical instrument or performance part to be excluded from a performance or to be performed solo results in a distinction being made by use of identification data between a channel to which performance data to be reproduced belongs and a channel to which performance data not to be reproduced belongs. As a result, even if the user does not know all the performance parts or musical instruments assigned to each channel, the user can specify a performance part or musical instrument to be excluded from a performance or to be performed solo. Furthermore, even if one musical instrument is assigned to a plurality of channels such as a backing part and solo part, the distinction between performance parts to be excluded and to be solo-performed can be easily done by assigning unique identification data to each channel. As a result, the present invention allows for easy specification of performance parts to be reproduced and not to be reproduced, appropriately controlling the reproduction and non-reproduction of performance parts.

Another feature of the present invention lies in the automatic performance apparatus further comprising a display portion for displaying, based on category status data representative of the identification data contained in the series of performance data, the identification data before reproducing the series of performance data, the category status data being included in the automatic performance data with the identification data followed.

According to this feature, even if the automatic performance apparatus is unable to read all the automatic performance data for a music piece at one time due to its small capacity of a storage device for storing or temporarily storing performance data in the apparatus, the display of identification data on the basis of the category status data enables the user to know in advance the configuration of musical instruments or part configuration on the automatic performance data, facilitating the specification of a musical instrument or performance part by the reproduction condition specification portion.

Still another feature of the present invention is to provide a denotation table in which denotation data denoting a name of a musical instrument or performance part is stored, with correspondence defined with the musical instrument or performance part represented by the identification data, and a name display portion for displaying, in accordance with the denotation data contained in the denotation table, a name of the musical instrument or performance part corresponding to the musical instrument or performance part represented by the identification data. This feature enables the user to visually recognize the name of the musical instrument or performance part represented by the identification data.

A further feature of the present invention lies in an automatic performance apparatus wherein the denotation table is a rewritable storage device, enabling the display of the name of the musical instrument or performance part corresponding to the musical instrument or performance part represented by the identification data to be changed in accordance with the denotation data stored in the denotation table. This feature allows the user to provide each automatic performance data with a unique name of a musical instrument or performance part and display the name.

From a different standpoint of the features of the present invention, another feature of the present invention lies in an automatic performance program including a plurality of steps which enable a computer to implement functions described in the above features. This feature also serves the above-described effects.

A still further feature lies in a storage medium storing automatic performance data having a series of performance data which is assigned to any one channel of a plurality of channels and to which a channel number indicative of the assigned channel is added, wherein identification data representative of a musical instrument or performance part to be performed automatically by performance data assigned to each channel is assigned to each of the channels and contained in the series of performance data. The storage medium might further store category status data representative of the identification data contained in the series of performance data. The storage medium might further store denotation data denoting a name of a musical instrument or performance part with correspondence defined with the musical instrument or performance part represented by the identification data. When automatic performance data stored in the storage medium is reproduced through the use of the above-described automatic performance apparatus and automatic performance program, the aforementioned effects can be obtained.

BRIEF DESCRIPTION OF THE DRAWINGS

FIG. 5A is a diagram showing a format of example automatic performance data, and FIG. 5B is a conceptual illustration of various data included in the automatic performance data;

FIG. 6 is a diagram showing a format of data stored in a mute state register;

FIG. 7 is a diagram showing a format of data stored in a channel status register; and FIG. 8A is a diagram showing a format of data stored in a default category table, and FIG. 8B is a diagram showing a format of data stored in an option category table.

DESCRIPTION OF THE PREFERRED EMBODIMENT

Figure 1:
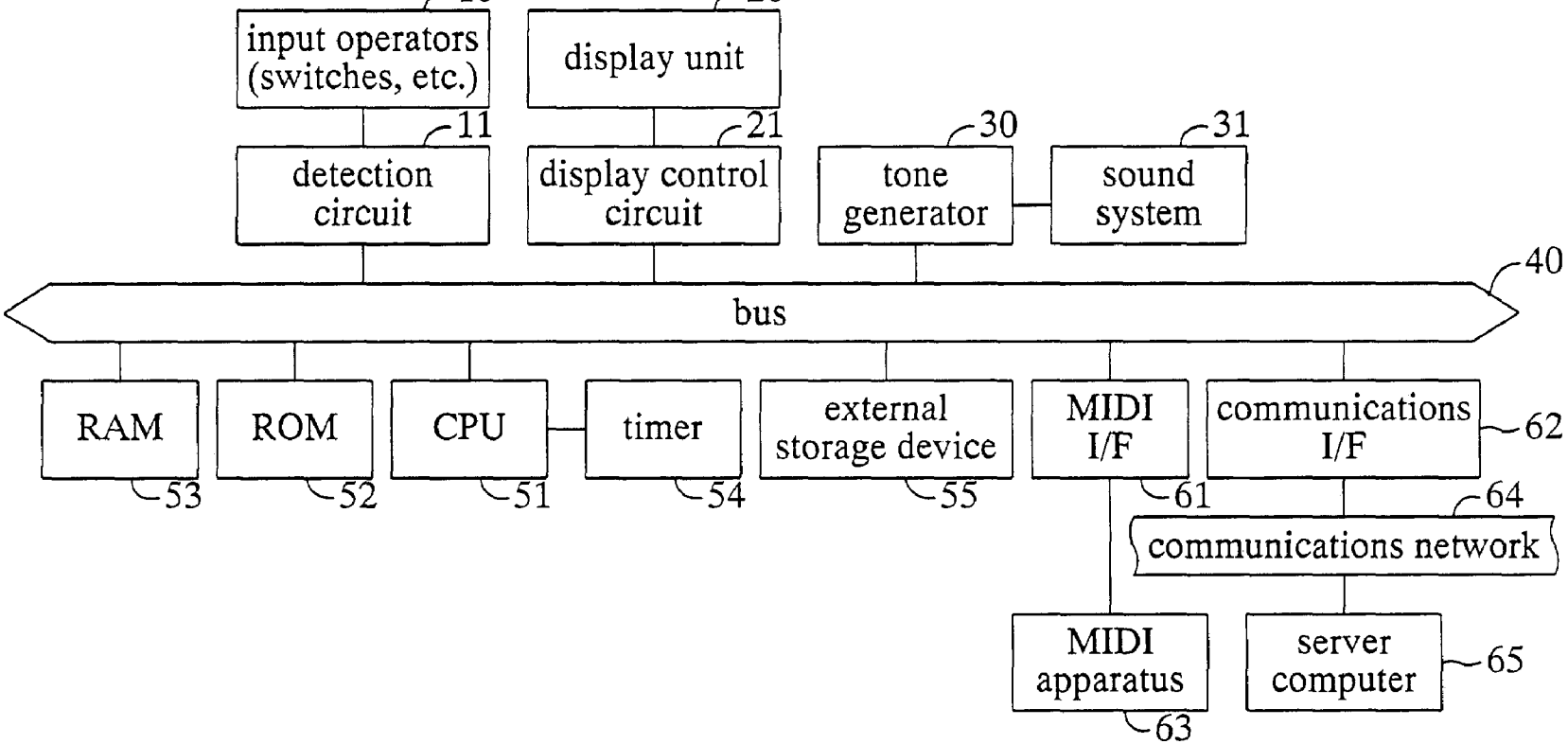
FIG. 1 is a schematic block diagram showing the whole of an automatic performance apparatus according to an embodiment of the present invention.

An embodiment of the present invention will now be described with reference to the drawings. FIG. 1 is a schematic block diagram showing an automatic performance apparatus according to the present invention. The automatic performance apparatus is applied to various electronic musical apparatuses capable of reproducing automatic performance data such as electronic musical instruments, sequencers, karaoke apparatuses, personal computers, game machines and mobile communications terminals.

The automatic performance apparatus is provided with input operators 10, a display unit 20 and a tone generator 30. The input operators 10 are operated by a user in order to input his/her instructions, comprising operators such as various key operators and a mouse. The key operators include a minus-one operator and solo performance operator which will be described in detail later. Operations of the input operators 10 are detected by a detection circuit 11 connected to a bus 40. The display unit 20, which is configured by a liquid crystal display, a cathode ray tube device, etc., displays various characters, notes, graphics and so on. The display conditions of the display unit 20 are controlled by a display control circuit 21 connected to the bus 40. The tone generator 30, which is equipped with tone signal forming channels, forms tone signals having the designated tone color at one tone signal forming channel designated on the basis of control signals fed through the bus 40. The formed tone signals are output to a sound system 31. The sound system 31, which comprises amplifiers, speakers, etc., emits musical tones corresponding to the received tone signals.

To the bus 40 there are also connected not only a CPU 51, ROM 52, RAM 53 and timer 54 comprising the main unit of a microcomputer, but also an external storage device 55. The CPU 51 and timer 54 are used in order to execute various programs including a program shown in FIGS. 2 through 4 for controlling various operations of an electronic musical instrument. The ROM 53 is provided with a default category table. In the default category table, as shown in FIG. 8A, there is stored denotation data denoting names of musical instruments, performance parts and melody attributes under three categories: main category, sub-category and melody attribute. The main category defines correspondences between musical instruments (e.g., piano, guitar) and musical instrument data, the sub-category defines correspondences between performance parts (e.g., right hand, left hand) and performance part data, and the melody attribute defines correspondences between melody attributes (e.g., melody 1, melody 2) and melody attribute data, respectively.

Figure 2:
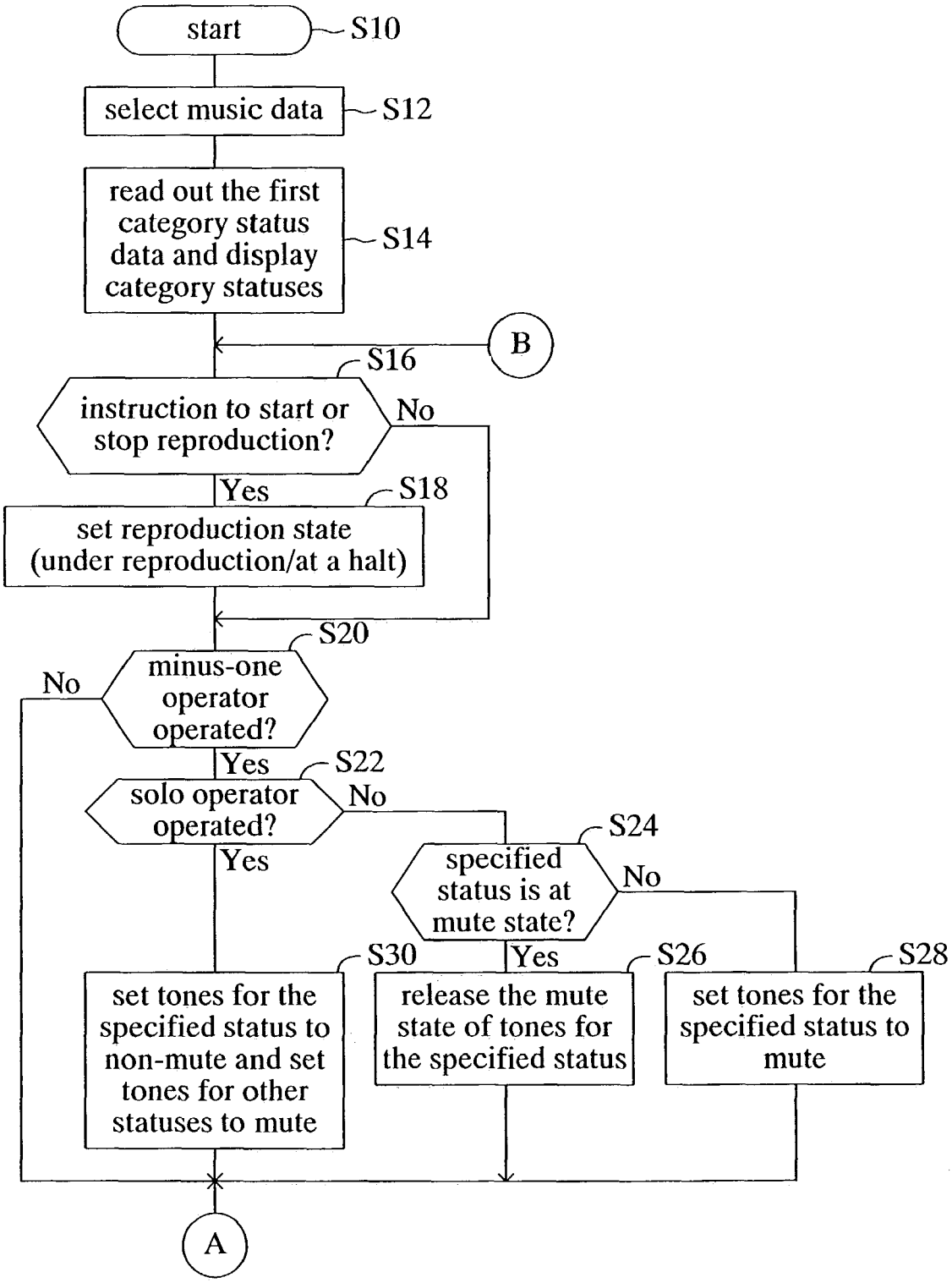
FIG. 2 is a flow chart showing the first half of a program executed by a CPU shown in FIG. 1.
Figure 3:
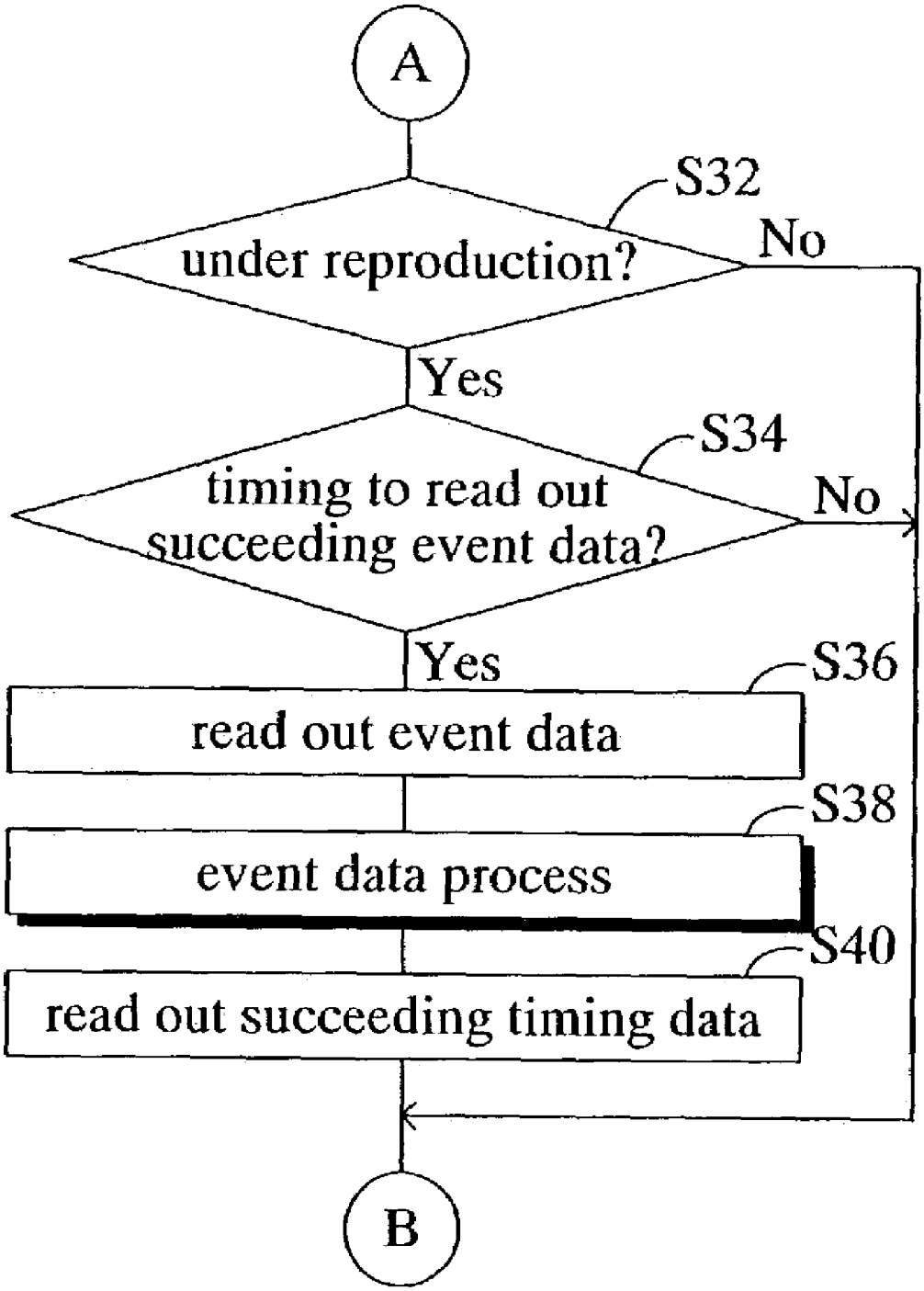
FIG. 3 is a flow chart showing the latter half of the program.
Figure 4:
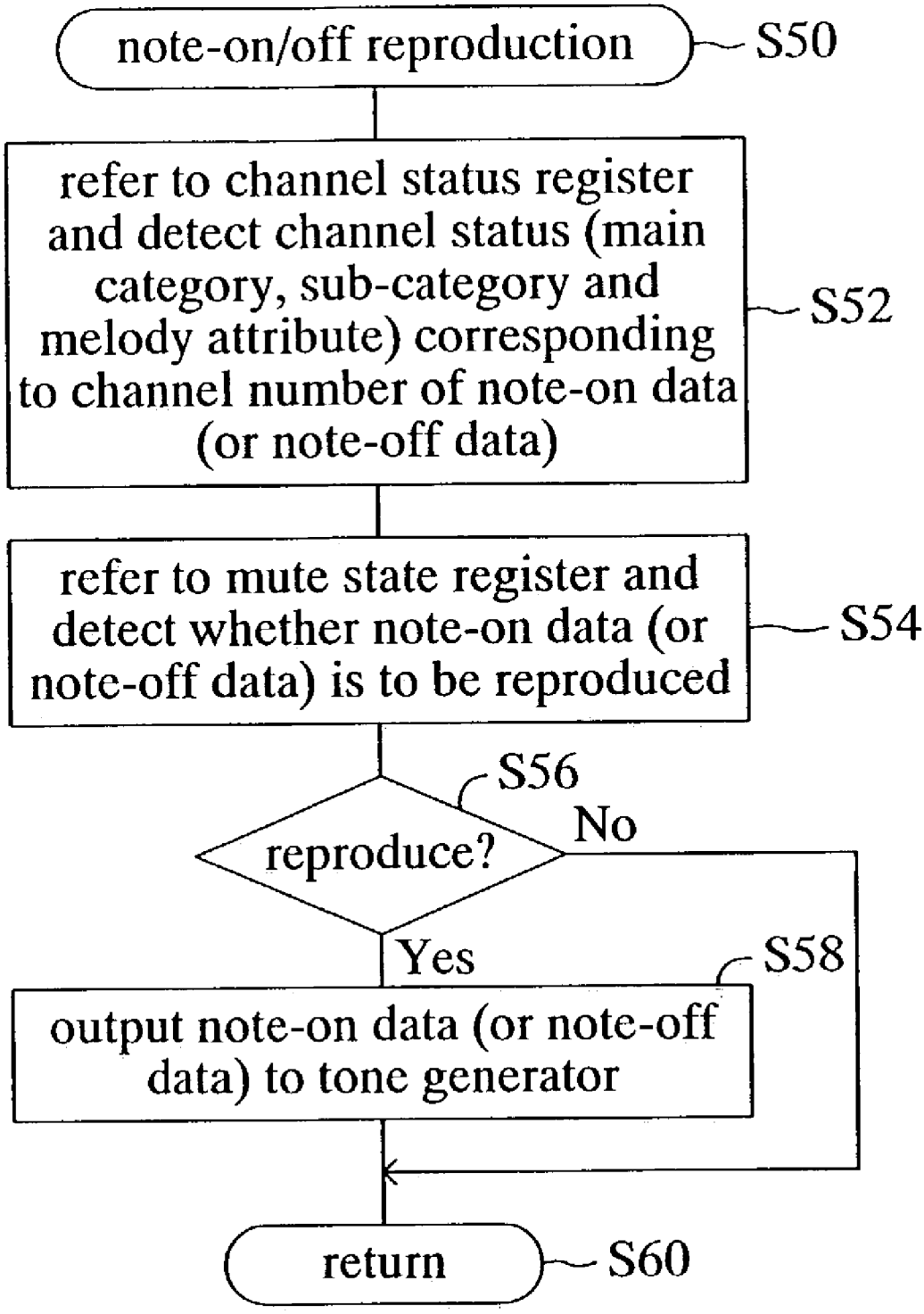
FIG. 4 is a flow chart of a note-on/off reproduction routine executed at an event data process of the program shown in FIG. 3.

In the RAM 53 there is provided a storage area which, on the execution of the program shown in FIGS. 2 through 4, receives and stores the program and music data of a selected music piece. The music data comprises a plurality of MIDI-compliant tracks composed of automatic performance data. As shown in FIG. 5A, the automatic performance data of each track comprises a series of event data and a series of timing data representative of time intervals between preceding and succeeding event data. The event data includes note-on data, note-off data, program change data, channel status data, category status data, channel status reset data and category name data. The automatic performance data in each track may include performance data on either one channel or a plurality of channels.

The note-on data is the data in which note number data representative of pitch and velocity data representative of loudness is added to identification data representative of note-on (start of emitting a tone). The note-off data is the data in which note number data representative of pitch and velocity data representative of loudness is added to identification data representative of note-off (end of emitting a tone). The program change data is the data in which to identification data indicative of the change of a tone color (program) tone color data representative of a tone color to replace is added. The note-on data, note-off data and program change data, each of which includes a channel number representative of a tone signal forming channel, comprises performance data stored in accordance with the passage of time (see FIG. 5B).

The channel status data, which represents the main category, subcategory and melody attribute of a tone signal forming channel, includes a channel number to which musical instrument data (main category), performance part data (sub-category) and melody attribute data is added (see FIG. 8A). As shown in the case of the value, "255" of FIG. 8A, the main category and/or sub-category may be left "unspecified". Similarly, the melody attribute may be left "non-melody". Due to the adoption of "unspecified" or "non-melody", the single specification in which only a main category or melody attribute is specified is possible. The channel status data, as shown in FIG. 5B, is placed at each top of the sets of the performance data units arranged in accordance with the passage of time. The category status data, which represents all the channel statuses (main categories, sub-categories and melody attribute channels) included in a set of music data and is placed at the front of the channel status data units, includes all the channel status data except channel numbers. The category status data, as exemplified in FIG. 5B, is placed at the top of the music data.

The channel status reset data is the data which resets a channel status resister and option category table described in detail later to their initial state. The category name data, which updates the option category table described later, as shown in FIG. 8B, comprises main category data representative of main category (e.g., option 1, option 2), sub-category data representative of sub-category (e.g., option 1, option 2) and melody attribute data representative of melody attribute(e.g., option 1, option 2), and denotation data indicative of option name (e.g., Suzuki, Nakata, Vocal, Chorus 1, Melody, Soprano) corresponding to the above data. The category name data, in particular, which is arbitrarily provided by the user, may not be necessarily a name of a musical instrument or performance part. In the above example, for instance, the name of a performer, "Suzuki" is provided instead of the name of a musical instrument. The channel status reset data and category name data is included in performance data in FIG. 5A when necessary.

In the RAM 53, a mute state register, channel status register and option category table are also provided on the execution of the program shown in FIGS. 2 through 4. As shown in FIG. 6, the mute state register is equipped with a storage area for storing mute data M which indicates whether performance data is to be reproduced (whether musical tones are to be sounded), the mute data M being associated with main category data, sub-category data and melody attribute data. Specifically, the presence of the mute data M indicates that the performance data is not to be reproduced, while the absence of the mute data M indicates that the performance data is to be reproduced. As shown in FIG. 7, the channel status register is equipped with a storage area for storing data indicative of the current channel status (main category, sub-category and melody attribute) of each channel, the data being associated with each channel (channel number). As shown in FIG. 8B, the option category table stores main category data, sub-category data and melody attribute data along with denotation data denoting user-specific option names in the associated relation with the above data. The option category table is updated on the basis of automatic performance data described in detail later or of user's operation on the input operators 10.

The external storage device 55 comprises a storage medium previously equipped with the automatic performance apparatus such as a hard disk HD, storage media applicable to the automatic performance apparatus such as a flexible disk FD, compact disk CD and semiconductor memory, and drive units for reading and writing programs and data from/to the above storage media. In these storage media there are stored various programs and data. In the present embodiment, specifically, also stored in these storage media is a program shown in FIGS. 2 through 4 and sets of automatic performance data corresponding to various music pieces, although some of these programs and data are stored in the ROM 52.

Also connected to the bus 40 are a MIDI interface circuit 61 and communications interface circuit 62. The MIDI interface circuit 61 is an interface circuit which is connected to a MIDI-compatible apparatus 63 such as a performance apparatus including an automatic performance device (sequencer) and musical keyboard, other musical instrument and personal computer for receiving various MIDI information including automatic performance data from the MIDI apparatus 63 or transmitting various MIDI information to the MIDI apparatus 63. The communications interface circuit 62 enables the automatic performance apparatus to communicate with an external apparatus including a server computer 65 through a communications network 64 such as the Internet.

Next, operations of the embodiment configured as described above will be explained. Initially, a user starts the program of FIGS. 2 through 4 stored in a storage medium such as the hard disk HD, flexible disk FD, compact disk CD or semiconductor memory in the external storage device 55, or the ROM 52. By this startup, the above program is transmitted to and stored in the RAM 53. In the cases where the program is not stored in the external storage device 55 or ROM 52, the program may be provided externally from the MIDI-compatible apparatus 63 through the MIDI interface circuit 61 or from the server computer 65 through the communications interface circuit 62 and communications network 64.

The program is started at step S10 in FIG. 2. Looking at the screen of the display unit 20, at step S12 the user operates the input operators 10 in order to select a set of music data from among sets of music data stored in the storage medium such as hard disk HD, flexible disk FD, compact disk CD or semiconductor memory, or the ROM 52. By this selection, the selected music data is transmitted to and stored in the RAM 53. Music data available here includes such data that is stored in the MIDI-compatible apparatus 63 and can be input through the MIDI interface circuit 61, and that can be provided from outside including the case where the server computer 65 is used through the communications interface circuit 62 and communications network 64.

Operations by use of the music data stored in the RAM 53 will be described hereinbelow. Although music data comprising tracks of automatic performance data requires processes described below for each track, the processes are common to all the tracks. Therefore, description on the operations based on automatic performance data for a track shown in FIG. 5A and 5B will be given.

After processing the step S12, at step S14 the CPU 51 reads out the first category status data from among automatic performance data from the RAM 53 and stores the read-out data in the mute state register provided in another storage area of the RAM 53 (see FIG. 6), displaying on the display unit 20 all the main categories (names of musical instruments), sub-categories (names of performance parts) and melody attributes represented by the read category status data. In order to display them, the CPU 51 refers to the default category table provided in the ROM 52 and uses denotation data corresponding to the main category data, sub-category data and melody attribute data. The resultant display allows the user to visually recognize all the channel statuses included in the automatic performance data. On this display, the CPU 51 may refer to the option category table shown in FIG. 8B instead of the default category table.

After processing the step S14, the CPU 51 repeats a loop process composed of steps S16 through S40 (FIG. 3). At this loop process, the CPU 51 determines at step S16 whether the user has made an instruction to start or stop reproducing automatic performance data. When no instruction has been made, the CPU 51 gives "NO" at step S16 and executes a reproduction condition specification process composed of steps S20 through S30. In this specification process, a musical instrument or performance part is specified to be excluded from the performance during the reproduction of the performance data, or to be performed with other musical instrument or other performance part excluded from the performance during the reproduction of the performance data.

At steps S20 and S22, the CPU 51 determines whether the minus-one operator and solo operator has been operated, respectively. On the determination of the minus-one operator, the CPU 51 determines whether an operator designed specifically for instructing a minus-one performance and provided in the input operators 10 such as "piano right hand" and "solo guitar" has been operated by the user. Alternatively, the user may specify on the screen of the display unit 20 displaying category statuses as described above one category status from among the displayed category statuses (main categories, sub-categories and melody attributes). This operation of the minus-one operator may specify either a musical instrument and performance part such as "piano right hand" or only performance part such as "right hand" or "melody 1" without specifying a main category indicative of a musical instrument. Furthermore, the operation of the minus-one operator may also specify only a main category indicative of a musical instrument. As for the solo operator as well, the CPU 51 determines whether the solo operator which is designed specifically for instructing a solo performance and provided in the input operators 10 has been operated by the user. Alternatively, the user may also specify a musical instrument to perform solo from among those displayed on the screen of the display unit 20.

When the minus-one operator has been operated, and the solo operator has not been operated, the CPU 51 gives "YES" at step S20 and "NO" at step S22 and executes steps S24 through S28. On processing steps S24 through S28, when mute data M is stored in the mute storage area corresponding to the status (main category, sub-category and melody attribute) specified at the operation of the minus-one operator, the mute storage area being provided in the mute state register of the RAM 53, the mute data M is cleared in order to release the mute state(non-reproduction) of musical tones belonging to the specified status. On the other hand, when mute data M is not stored in the mute storage area corresponding to the specified status, mute data M is written to the storage area in order to mute (not to reproduce)the musical tones belonging to the specified status.

On the other hand, when both the minus-one operator and solo operator have been operated, the CPU 51 gives "YES" at both steps S20 and S22 and executes a solo performance setting process at step S30. At the solo performance setting process, the CPU 51 clears mute data M in the mute storage area corresponding to the status (main category, sub-category and melody attribute) specified by the operation of the minus-one operator, the mute storage area being provided in the mute state register of the RAM 53. By the clearance of the mute data M, musical tones belonging to the specified status are set to non-mute (reproduction). Additionally, the mute data M is written to the mute storage area for the statuses other than the status specified by the operation of the minus-one operator in order to mute (not to reproduce) musical tones belonging to the statuses other than the specified status. When the minus-one operator has not been operated, the CPU 51 gives "NO" at step S20 and proceeds to step S32 shown in FIG. 3.

At step S32 the CPU 51 determines whether performance data is under reproduction. If not, the CPU 51 gives "NO" at step S32 and returns to step S16 shown in FIG. 2. On the other hand, when the user has operated the input operators 10 in order to start or stop reproducing, the CPU 51 gives "YES" at the step S16 and executes a process for setting a reproduction state at step S18. At this process for setting the reproduction state, when performance data is under reproduction, the CPU 51 causes the automatic performance apparatus to stop reproducing the data. When the reproduction of performance data is being stopped, the CPU 51 causes the automatic performance apparatus to reproduce the data.

When the automatic performance apparatus is thus set to reproduce the performance data, the CPU 51 gives "YES" at step S32 and executes a process for reading out event data composed of steps S34 through S38. At this process, the CPU 51 counts the time (the time lapsed until succeeding event data is to be read out) indicated by timing data read out at step S40 by use of a program process which is not shown and keeps giving "NO" at step S34 until the above indicated time lapses. When the timing to read out the succeeding event data has come, the CPU 51 gives "YES" at step S34 based on the time-count, reads out the succeeding event data at step S36, and executes at step S38 an event data process on the read-out event data.

Now the event data process will be explained in detail. Although event data includes various data, a case in which event data is program change data and channel status data will be explained first for convenience of explanation. When program change data is read out, tone color control data for forming tone signals having a tone color (musical instrument) represented by tone color data in the program change data is fed to one tone signal forming channel among tone signal forming channels in the tone generator 30. The tone signal forming channel to receive the tone color control data is specified by a channel number added to the program change data. This feeding enables the tone signal forming channel to form musical tones having the tone color represented by the tone color data, namely, to form tone signals specified by the tone color data.

On the other hand, when channel status data is read out, main category data, sub-category data and melody attribute data which has been stored in storage area corresponding to the channel number added to the above read-out channel status data, the storage area being contained in the channel status register (see FIG. 7) provided in the RAM 53, is updated to the main category data, sub-category data and melody attribute data composing the above read-out channel status data. Roughly concurrently with the update, referring the default category table (see FIG. 8A) provided in the ROM 52, on the display unit 20 there are displayed the channel number along with the name of the musical instrument (the name of the tone color), name of the performance part and melody attribute corresponding to the main category data, sub-category data and melody attribute data composing the above read-out channel status data. For the display of the channel number and these names, denotation data denoting the name of the musical instrument (tone color name) as main category, performance part as sub-category and melody attribute is used, respectively. Alternatively, in order to display on the display unit 20 the channel number along with the name of the musical instrument (the name of the tone color), name of the performance part and melody attribute, the option category table shown in FIG. 8B may be referred to. By this display, the user is allowed to visually recognize the main categories (names of musical instruments: names of tone colors), sub-categories (performance parts) and melody attributes currently available on tone signal forming channels belonging to the tone generator 30.

When note-on data or note-off data is read out, based on various data stored in the above-described mute state register and channel status register, the CPU 51 controls, on the basis of the above read-out note-on data or note-off data, the reproducing of musical tones and muting of the musical tones. More specifically, when note-on data or note-off data is read out, the CPU 51 executes a note-on/off reproduction routine shown in FIG. 4 as the event data process of step S38 in FIG. 3.

The note-on/off reproduction routine is started at step S50. At step S52 the CPU 51 refers to the channel status register (see FIG. 7) in order to detect the channel status (main category, sub-category and melody attribute) corresponding to the channel number added to the note-on data or note-off data. More specifically, the CPU 51 detects the musical instrument (tone color), performance part and melody attribute corresponding to the above channel number. The CPU 51 then refers to the mute state register (see FIG. 6) at step S54 in order to determine by use of the detected channel status whether the read-out note-on data or note-off data is to be reproduced.

When the CPU 51 determines at step S54 to reproduce the data, the CPU 51 gives "YES" at step S56 and outputs the read-out note-on data or note-off data to the tone generator 30, terminating the note-on/off reproduction routine at step S60. When note-on data is output, in the tone generator 30 the tone signal forming channel specified by the channel number added to the note-on data forms tone signals having the pitch specified by the note number data included in the note-on data and having the loudness specified by the velocity data included in the note-on data and outputs the signals to the sound system 31. The sound system 31 emits musical tones corresponding to the tone signals. The tone color of the tone signals of this case, which is specified by the above program change data, corresponds to the name of the musical instrument listed by channel on the display unit 20.

When note-off data is output to the tone generator 30, the tone generator 30 stops forming and emitting tone signals specified by the note-off data. As a result, when the note-on data and note-off data (performance data) belongs to the main category (musical instrument) or sub-category (performance part) which the user has instructed to reproduce, musical tones on the performance data are emitted, realizing an automatic performance based on the performance data.

On the other hand, when the CPU 51 determines at the step S54 that the data is not to be reproduced, the CPU 51 gives "NO" at step S56 and terminates the note-on/off reproduction routine at step S60 without executing step S58. As a result, musical tones based on the note-on data and note-off data (performance data) belonging to the main category (musical instrument) or sub-category (performance part) specified by the user not to be reproduced are not emitted. Although the present embodiment completely blocks the generation of musical tones on performance data specified not to be reproduced, the present embodiment may be allowed to emit such tones at inaudible loudness levels or low loudness levels which is nearly inaudible. In the present invention, the generation of musical tones at such low loudness levels is considered to be equivalent to the case in which the generation of specific tones is blocked.

Next explained will be the case in which category name data, channel status reset data and category status data is read out as event data at step S36. When category name data is read out, the option category table (see FIG. 8B) provided in the RAM 53 is updated to the read-out category name data by the event data process of step S38. These processes allow the user to define a unique name of a musical instrument or performance part for each automatic performance data and to display such name.

When channel status reset data is read out, the channel status register (see FIG. 7) and option category table (see FIG. 8B) provided in the RAM 53 are reset to the initial state by the event data process of step S38. In this case, the CPU 51 refers to the default category table (see FIG. 8A) provided in the RAM 53 and displays on the display unit 20 the channel status stored in the channel status register. The CPU 51 may refer to the option category table (see FIG. 8B) and displays on the display unit 20 the channel status stored in the channel status register.

When category status data is read out, the CPU 51 updates the mute state register (see FIG. 6) provided in the RAM 53 by the event data process of step S38 and displays the updated data on the display unit 20 as in the case of the above-described step S14. As a result, when category status data is read out during reproducing automatic performance data, this process changes based on this event data the main category (musical instrument), sub-category (performance part) and melody attribute so that they coincide with the above-read category status data, and allows the user to visually recognize the changed main category, sub-category and melody attribute.

According to the above embodiment, as explained above, the processes of steps S20 through S30 conduct the following: when a musical instrument or performance part is specified to be performed or not to be performed, the event data process of step S38 (steps S50 through S60) distinguishes between a channel to which performance data to be reproduced belongs and that to which performance data not to be reproduced belongs. This process allows the user to specify a performance part or musical instrument not to be performed or to be performed solo, eliminating the user's need for having to know the assignments between channels and performance parts or musical instruments. Moreover, even when there exist a plurality of channels to which an identical musical instrument is assigned such as a backing part and solo part, the specification of sub-category (performance part) provides easy identification of a specific performance part not to be performed or to be solo-performed.

Furthermore, in carrying out the present invention, it will be understood that the present invention is not limited to the above-described embodiment, but various modifications may be made without departing from the spirit and scope of the invention.

In the above embodiment, for example, category status data is arranged such that it precedes a series of performance data in each track. However, as for music data storing automatic performance data for a plurality of tracks, all the category status data for the tracks may be stored in a specified track, with the category status data being placed at the position preceding a series of performance data.

In the above embodiment, furthermore, the RAM 53 having large capacity is used to receive and store automatic performance data for one music piece. However, if a small-capacity RAM 53 incapable of storing automatic performance data for a music piece is used, the automatic performance apparatus may be modified such that it takes part of the automatic performance data little by little into the RAM 53 for reproducing it. In this case as well as the above case, the category status data is stored such that it precedes a plurality of channel status data units and a series of performance data. In this case, moreover, the CPU 51 reads out the category status data at step S14 before reproducing music data, and displays on the display unit 20 all the main categories (names of musical instruments), sub-categories (performance parts) and melody attributes represented by the category status data and included in the automatic performance data for a music piece. Such display enables the user to know in advance the configuration of musical instruments or part configuration on the automatic performance data, facilitating the retrieval on a performance part basis.

In the above embodiment, additionally, a case has been presented in which the channel status data and category status data serving as identification data representative of musical instrument and performance part comprises three pieces of information: main category, sub-category and melody attribute. However, the channel status data and category status data may comprise either one piece of information, two pieces of information or four or more pieces of information.

In the above embodiment, furthermore, performance data belonging to one main category (musical instrument) or one sub-category (performance part)is designated as solo. However, performance data belonging to a plurality of main categories or a plurality of sub-categories may be designated as solo. In this case, for example, main categories or sub-categories may be designated as solo by operating a plurality of minus-one operators during operating the solo operator. Alternatively, this multiple designation may be done by providing the automatic performance apparatus with separate solo operators for the main categories and sub-categories and concurrently operating these solo operators. Moreover, although the above embodiment is not equipped with a function for resetting solo-performance, the reset function may be added.

Furthermore, the format of the performance data available is not limited to the format employed by the above embodiment in which channel numbers are added to each performance data; applicable formats include such that each track is associated with a channel number, without adding channel numbers to each performance data. Moreover, although the performance data format employed by the above embodiment is provided with note-on data and note-off data separately, such format may be applicable that the generation of musical tones is controlled by "note-on plus gate time". Furthermore, although in the performance data format of the above embodiment performance data is stored along with other data including channel status data altogether in the same track, such format may also be applicable that the performance data and the other data such as channel status data is stored in separate track.

What is claimed is:

1. An automatic performance apparatus for reproducing automatic performance data which has a series of performance data assigned to any one channel of a plurality of channels, the series of performance data having identification data, representative of a performance part performed by performance data assigned to each channel, assigned to each of said channels, said automatic performance apparatus comprising:

a reproduction condition specification portion for specifying a performance part to be excluded from a performance during the reproduction of performance data, or to be performed with any other performance part excluded from a performance during the reproduction of performance data and;

a reproduction control portion for identifying a performance part to be performed by each performance data based on said identification data, and controlling reproduction and non-reproduction of each performance data in accordance with the reproduction condition specified by said reproduction condition specification portion, wherein said reproduction condition specification portion includes a mute state register for storing, on the basis of the specification of said performance part, mute data indicative of whether performance data is to be reproduced in corresponding relation to the performance part; and said reproduction control portion includes an identification data register for storing said identification data during reproducing said series of performance data;

a first detector for referring to the identification data stored in said identification data register and detecting a performance part to be performed by each of said performance data by use of the channels assigned to each of said performance data; and a second detector for referring to mute data stored in said mute state register and detecting by use of said detected performance part whether each of said performance data is to be reproduced.

2. An automatic performance apparatus according to claim 1, further comprising:

a display portion for displaying, based on category status data representative of the identification data contained in the series of performance data, the identification data before reproducing the series of performance data, the category status data being included in said automatic performance data with the identification data following.

3. An automatic performance apparatus according to claim 1, further comprising:

a denotation table in which denotation data denoting a name of a performance part is stored, with correspondence defined with the performance part represented by said identification data; and a name display portion for displaying, in accordance with the denotation data contained in said denotation table, a name of a performance part corresponding to the performance part represented by said identification data.

4. An automatic performance apparatus according to claim 3, wherein said denotation table is a rewritable storage device, enabling the display of the name of the performance part corresponding to the performance part represented by said identification data to be changed in accordance with the denotation data stored in said denotation table.

5. An automatic performance apparatus according to claim 1, wherein said identification data further includes data representative of a musical instrument performed by performance data assigned to each channel;

said reproduction condition specification portion for specifying a combination of a musical instrument and performance part to be excluded from a performance during the reproduction of performance data, or to be performed with any other combination of a musical instrument and performance part excluded from a performance during the reproduction of performance data; and said reproduction control portion for identifying a combination of a musical instrument and performance part to be performed by each performance data based on said identification data, and controlling reproduction and non-reproduction of each performance data in accordance with the reproduction condition specified by said reproduction condition specification portion.

6. A computer-readable medium comprising performance program executed on a computer for reproducing automatic performance data which has a series of performance data assigned to any one channel of a plurality of channels, the series of performance data having identification data, representative of a performance part performed by performance data assigned to each channel, assigned to each of said channels, said program including the steps of:

specifying a performance part to be excluded from a performance during the reproduction of performance data, or to be performed with any other performance part excluded from a performance during the reproduction of performance data; and identifying a performance part to be performed by each performance data based on said identification data, and controlling reproduction and non-reproduction of each performance data in accordance with the reproduction condition specified by said specifying step, wherein said specifying step includes storing mute data indicative of whether performance data is to be reproduced in corresponding relation to the performance part in a mute state register on the basis of the specification of said performance part; and said identifying step includes storing said identification data in an identification data storing register during reproducing said series of performance data;

referring to the identification data stored in said identification data register and detecting a performance part to be performed by each of said performance data by use of the channels assigned to each of said performance data; and referring to mute data stored in said mute state register and detecting by use of said detected performance part whether each of said performance data is to be reproduced.

7. A computer-readable medium comprising performance program according to claim 6, further including:

displaying, based on category status data representative of the identification data contained in the series of performance data, the identification data on a display unit before reproducing the series of performance data, the category status data being included in said automatic performance data with the identification data following.

8. A computer-readbale medium comprising performance program according to claim 6, further including:

displaying a name of a performance part corresponding to the performance part represented by said identification data in accordance with the denotation data contained in a denotation table, said denotation table storing denotation data denoting a name of a performance part with correspondence defined with the performance part represented by said identification data.

9. A computer-readable medium comprising performance program according to claim 8, wherein said denotation table is rewritable storage device, enabling the display of the name of the performance part corresponding to the performance part represented by said identification data to be changed in accordance with the denotation data store in said denotation table.

10. A computer-readable medium comprising performance program according to claim 6, wherein said identification data further includes data representative of a musical instrument performed by performance data assigned to each channel;

said specifying step includes specifying a combination of a musical instrument and performance part to be excluded from a performance during the reproduction of performance data, or to be performed with any other combination of a musical instrument and performance part excluded from a performance during the reproduction of performance data; and said identifying step includes identifying a combination of a musical instrument and performance part to be performed by each performance data based on said identification data, and controlling reproduction and non-reproduction of each performance data in accordance with the reproduction condition specified by said specifying step.

* * * * *